United States Patent [19]

Hoy, Jr.

[11] Patent Number: 4,759,095

[45] Date of Patent: Jul. 26, 1988

[54] VACUUM CLEANER PICK-UP DEVICE

[75] Inventor: Harry L. Hoy, Jr., Dearborn, Mich.

[73] Assignee: Leonard T. Rutkowski, Dearborn, Mich. ; a part interest

[21] Appl. No.: 75,420

[22] Filed: Jul. 20, 1987

[51] Int. Cl.[4] ..... A47L 9/00

[52] U.S. Cl. ..... 15/339; 209/215

[58] Field of Search ..... 15/339; 209/215

[56] References Cited

U.S. PATENT DOCUMENTS

| | | | |
|---|---|---|---|
| 2,288,115 | 6/1942 | Soldanels | 15/339 |
| 2,677,461 | 5/1954 | Bodey | 15/339 X |
| 2,847,084 | 8/1958 | Wolfskill et al. | 15/399 X |
| 3,084,495 | 4/1963 | Blackerby | 209/215 X |
| 3,206,783 | 9/1965 | Schwartz | 209/215 X |
| 4,006,512 | 2/1977 | Saulson | 15/339 |
| 4,279,745 | 7/1981 | Haase | 15/339 X |
| 4,300,260 | 11/1981 | Hill | 15/339 |

*Primary Examiner*—Chris K. Moore

*Attorney, Agent, or Firm*—Charles W. Chandler

[57] ABSTRACT

A magnetic pick-up device for a vacuum sweeper comprises a series of magnetically-attractive strips mounted in an open-bottomed plastic housing. The pick-up housing is mounted on the vacuum cleaner housing by a pair of cooperating extruded sections that are frictionally engaged such that the pick-up housing can be moved parallel to the length of the extruded sections to separate the pick-up housing from the vacuum cleaner housing.

3 Claims, 1 Drawing Sheet

VACUUM CLEANER PICK-UP DEVICE

BACKGROUND OF THE INVENTION

This invention is related to magnetic pick-up devices for vacuum sweepers, and more particularly to a pick-up device having an elongated housing that is mounted on the front of a vacuum sweeper and releasably connected to the vacuum sweeper housing by a cooperating pair of extruded sections, one of which has a slot for receiving a lip on the other section.

Vacuum sweepers, especially in commercial applications, frequently experience the problem of picking up small metallic objects which enter the machine and have a detrimental effect on its internal components. Some devices are known in the prior art in which a magnetic material is mounted on the front of the vacuum sweeper housing, forward of the vacuum sweeper housing as it is being pushed in a cleaning motion, to pick up the magnetic metal objects before they enter the vacuum sweeper housing. Such products have not received a wide commercial acceptance for a variety of reasons. For example, one such device is illustrated in U.S. Pat. No. 4,006,512 which issued Feb. 8, 1977 to Saul S. Saulson. The Saulson device has a magnet mounted to function as a bumper, that is, on the forward side of the pick-up device frame. In order to remove the pick-up device from the vacuum sweeper, the user must use a tool to unfasten a pair of bolts, a time-consuming activity.

SUMMARY OF THE INVENTION

The broad purpose of the present invention is to provide an improved magnetic pick-up device having a housing mounted on the sweeper housing with several internally mounted magnetic strips. The pick-up housing carries a square, hollow, extruded element about 6 inches long. The square extrusion has a longitudinal slot in the mid-section of one wall. A second, cooperating extrusion has a pair of parallel walls formed in a somewhat "H" shaped configuration. One wall is attached to the front wall of the vacuum sweeper housing, parallel to the ground. The second wall is receivable in the slot of the square extrusion by a longitudinal motion of the pick-up device housing. The inside surface of the slotted wall of the square extrusion is disposed surface-to-surface with the inside surface of the other wall of the second extrusion in a frictional engagement. The frictional engagement between the two extrusions firmly holds the pick-up device in position, however, the pick-up device can be quickly removed from the vacuum sweeper simply by sliding if off the "H" shaped extrusion.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
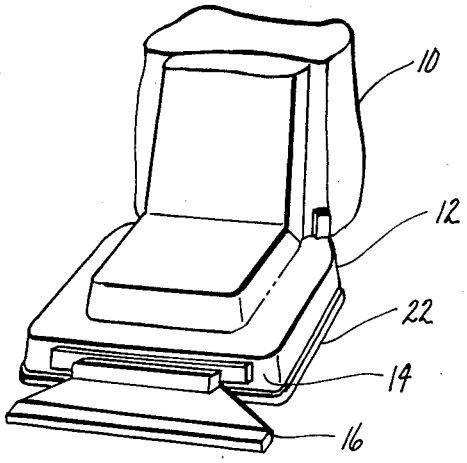
FIG. 1 is a perspective view of a vacuum sweeper housing having a magnetic pick-up device illustrating the preferred embodiment of the invention.

Referring to the drawing, FIG. 1 illustrates a conventional vacuum sweeper 10 having an open-bottom housing 12 and a forward wall 14.

Figure 2:
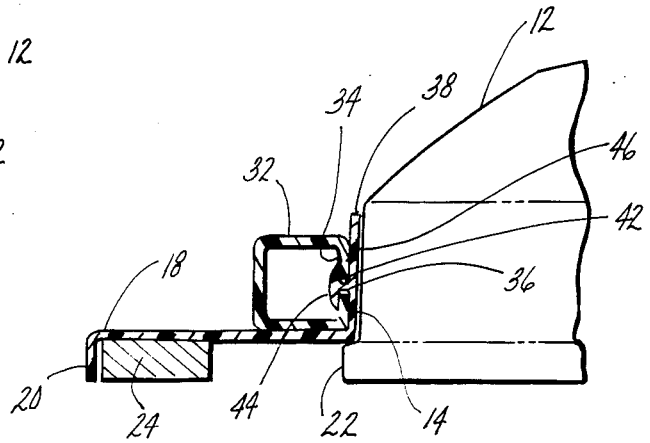
FIG. 2 is a sectional view of the pick-up device housing.

A pick-up device 16 is mounted on forward wall 14 of the vacuum sweeper. The pick-up device includes an open-bottom housing 18 formed of a non-magnetic, non-marring, plastic material, and having a generally "L" shaped cross-section, as best illustrated in FIG. 2. Housing 18 includes a downwardly depending skirt 20 which is spaced forward of bumper 22 of the vacuum sweeper so as to function as a forward bumper.

Figure 3:
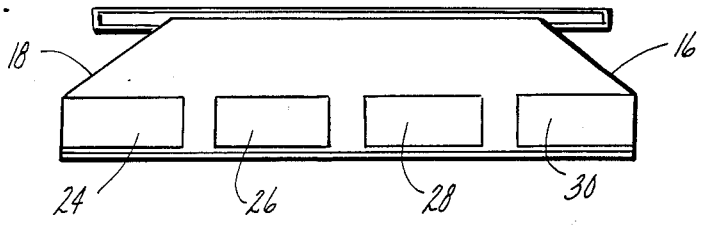
FIG. 3 is a bottom view of the pick-up device housing.
Figure 4:
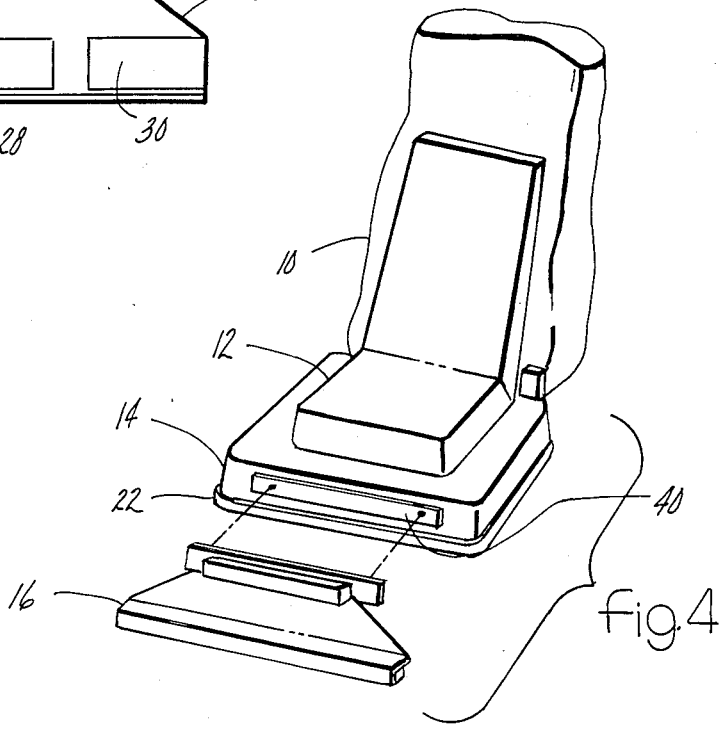
FIG. 4 is a view illustrating the pick-up device housing separated from the vacuum sweeper housing.

As best illustrated in FIG. 3, four magnetically attractive strips 24, 26, 28 and 30 are mounted on the inside of housing 18 rearward of skirt 20 and have a thickness slightly greater than the depth of skirt 20. Housing 18 has a width generally corresponding to the width of the vacuum sweeper housing so that strips 24–30 are spaced along a combined distance corresponding to the width of the vacuum sweeper housing wall. Magnetic strips 24–30 are adapted to pick up small, magnetically-attractive metal objects before they are picked up by the vacuum sweeper.

A square extrusion 32 of a plastic non-magnetic material is mounted along the back top edge of housing 18 and has a rear wall 34. Rear wall 34 has a longitudinal slot 36 running the full length of its midsection.

A second extrusion 38 is mounted, preferably by an adhesive material 40, to the forward wall of the vacuum sweeper housing directly above bumper 22.

The connection between extrusion 38 and the vacuum sweeper housing is a relatively permanent connection. Extrusion 38 preferably has a somewhat "H" shaped configuration including a pair of spaced walls 42 and 44 connected by an intermediate section 46. Extrusion 38 is preferably about 1½ inches longer than extrusion 32 and wall 44 is adaptable to be slideably received into slot 36 of square extrusion 32 so that its inside surface frictionaly engages the inside surface of wall 34 in a surface to surface engagement. The thickness of intermediate section 46 is somewhat less than the distance between the opposite edges of slot 36.

The frictional engagement between the inside surface of wall 44 and the inside surface of wall 34 is sufficient so that when the pick-up device housing is mounted on the vacuum sweeper housing, it is securely supported in position, however, the pick-up device can be quickly and easily removed from the vacuum sweeper housing by the user by simply slideably moving the pick-up device housing in a motion parallel to extrusion 38 in order to remove any metal objects picked up by magnetic strips 24–30. Preferably the two extrusions are also formed of a plastic material similar to that of housing 18.

Magnets 24–30 are thus supported in a position above the carpet or other surface being cleaned to effectively pick up small metal objects.

Having described my invention, I claim:

1. The combination of a vacuum sweeper having a housing with a forward wall, and a forward bumper, and a magnetic pick-up device comprising:

a strip of a magnetized material adapted to magnetically attract objects;

an open bottom, elongated pick-up housing of a non-magnetically-attractive material;

means for mounting the open-bottom, pick-up housing to the forward wall of the vacuum sweeper housing such that the magnetized material is spaced from and forward of the vacuum sweeper bumper, the mounting means including:

a first hollow-extruded, open-ended element having a length accommodating the length of the pick-up device housing, the first extruded element having at least one elongated wall having a longitudinal slot therein;

a second extruded element having a pair of spaced sidewalls joined together by an intermediate section in a generally "H" shaped configuration, the sidewalls being spaced a distance accommodating the thickness of the wall of the first extruded element;

means for fastening one of said extruded elements to the pick-up housing, and means for fastening the other of the extruded elements to the vacuum sweeper wall;

one of the side walls of the second element being slideably receivable in the slot of the first extruded element to a position in which said side wall of the second extruded element is disposed in a surface-to-surface frictional engagement with slotted walls of the first extruded element;

whereby the pick-up device can be separated from the vacuum sweeper housing by moving the first extruded element parallel to the second extruded element so that objects picked up by the magnetically-attractive strip can be removed to a location remote from the vacuum sweeper.

2. A combination as defined in claim 1, in which the first and the second extruded elements are each formed of a non-magnetic material.

3. A combination as defined in claim 1, in which one of the extruded elements has a square cross-section.

* * * * *